United States Patent [19]

Premi

[11] Patent Number: 4,852,339

[45] Date of Patent: Aug. 1, 1989

[54] SPLICING DEVICE OPERATING WITH COMPRESSED AIR ADMIXED WITH A LIQUID, FOR SPLICING THREADS FOR TEXTILE YARNS

[75] Inventor: Mauro Premi, Saló , Italy

[73] Assignee: Mesdan S.p.A., Salo, Italy

[21] Appl. No.: 279,018

[22] Filed: Dec. 2, 1988

[30] Foreign Application Priority Data

Dec. 14, 1987 [IT] Italy ..... 22991 A/87

[51] Int. Cl.[4] ..... D01H 15/00

[52] U.S. Cl. ..... 57/22

[58] Field of Search ..... 57/22, 261–263, 57/297

[56] References Cited

U.S. PATENT DOCUMENTS

| | | | |
|---|---|---|---|
| 3,070,947 | 1/1963 | Toledo et al. | 57/22 |
| 3,407,583 | 10/1968 | Irwin et al. | 57/22 |
| 3,458,905 | 8/1969 | Dodson et al. | 57/22 X |
| 4,361,003 | 11/1982 | Bertoli | 57/22 |
| 4,437,298 | 3/1984 | Truzzi et al. | 57/22 |
| 4,438,621 | 3/1984 | Rohner | 57/22 |
| 4,441,308 | 4/1984 | Rohner et al. | 57/22 |
| 4,452,035 | 6/1984 | Rohner et al. | 57/22 |
| 4,506,497 | 3/1985 | Feuerlohn | 57/22 |
| 4,571,921 | 2/1986 | Bertrams | 57/22 |
| 4,574,573 | 3/1986 | Guzzoni | 57/22 |

FOREIGN PATENT DOCUMENTS

| | | | |
|---|---|---|---|
| 3323890 | 1/1985 | Fed. Rep. of Germany | 57/22 |

*Primary Examiner*—Donald Watkins

*Attorney, Agent, or Firm*—Cushman, Darby & Cushman

[57] ABSTRACT

A splicing device is proposed, for splicing threads or textile yarns with compressed air containing an added liquid, in which, in order to get rid of the need for a precise and careful metering of the liquid to be added to the compressed air, and in order to protect the mechanical parts of the device from undesired noxious effects due to their contact with the liquid entrained by the compressed air, the mixing chamber inside which the splicing of the threads or yarns takes place is positioned inside a tank which can be tightly sealed before and during the splicing operation, from which tank a discharge duct for the liquid-admixed compressed air starts.

8 Claims, 5 Drawing Sheets

Figure 1:
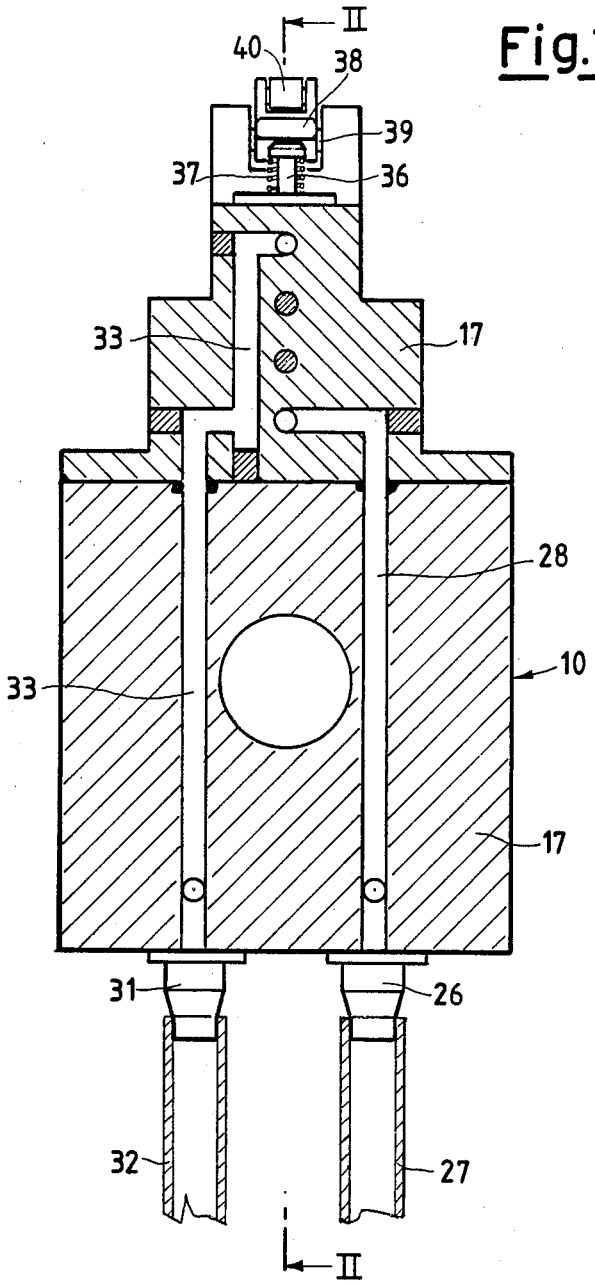

SPLICING DEVICE OPERATING WITH COMPRESSED AIR ADMIXED WITH A LIQUID, FOR SPLICING THREADS FOR TEXTILE YARNS

The present invention is concerned with a splicing device, operating with compressed air to which a liquid is added, in order to carry out the splicing of threads and textile yarns.

Splicing devices of this type are commonly known in the art, both as manually-controlled devices, and as automatic devices to be installed on textile machines, such as coner machines, and the like.

In the splicing technique for splicing threads and yarns by means of a compressed gas, in particular compressed air, the usefulness has been long known, of admixing the compressed gas with a small amount of a liquid, such as, e.g., water, in order to improve the quality of the splice, its appearance, and its tearing resistance, in particular when low-diameter yarns or threads have to be spliced, or when yarns or threads have to be spliced, which have a particular fibre structure, or anyway which are not easy to be spliced by means of a compressed gas (see U.S. Pat. Nos. 3,407,583; 3,274,764; and 3,458,905).

The problem inhering in this addition of a small amount of a liquid to the compressed gas used for splicing yarns or threads mainly consists in that the amount of the liquid has to be exactly metered, the liquid has to be well atomized or nebulized, and the metered amount of liquid has to be fed evenly distributed in the compressed gas into the chamber inside which the splicing of the threads or yarns takes place. An excessive amount of liquid added to the compressed gas may involve undesired noxious effects, e.g., due to corrosion, to the detriment of the mechanical parts of the device on which the liquid may deposit, whilst a too small amount of liquid may make it possible the desired advantageous effects on the quality of the splice not to be reached in case of threads or yarns difficult to be spliced.

Therefore, the prior art proposed (German Pat. No. 31 45 502) to add to the compressed gas a well-metered amount of a suspension containing a substance capable of improving the textile characteristics of the fibres, their mutual adhesion and the resistance of the thread or yarn without causing the fibres to get stuck to each other, together with a lubricating substance, not corrosive for the mechanical parts of the device.

Other proposals (as they can be drawn from German Pat. Nos. 33 03 419, 33 23 890, 33 37 895 and still others) provide particular methods and devices for the precise metering, and the introduction of small amounts of liquids into the compressed air used for carrying out the splicing, and for feeding the mixing chamber with the metered mixture constituted by compressed air and the liquid substance.

The purpose of the present invention is of solving the problem of providing a splicing device for splicing threads or textile yarns with the aid of a gas or compressed air to which a liquid is added, in which a precise and perfect metering of the liquid added to the splicing air is not necessary, and in which all the undesired noxious effects are reliably avoided, which this liquid may cause on the mechanical parts of the device and/or on the machine on which the same device is destined to be mounted.

The solution of this problem mainly consists, according to the present invention, in that the splicing head containing the mixing chamber, to which the feed duct leads, by means of which the liquid-admixed compressed air is fed, and inside which the splicing of the threads or yarns takes place, is positioned inside a tank isolated from the mechanical parts of the splicing device, that controllable means are provided for tightly sealing said tank immediately before and during the splicing operation, and that from said tank a discharge duct starts, through which the liquid-admixed compressed air charged to said chamber during the splicing operation is discharged.

In this way, any contacts of the liquid-admixed compressed air with the mechanical members of the device are prevented, hence any possibilities of deposition of the liquid on said mechanical members with consequent undesired noxious effects, such as the risk of corrosion of said mechanical members, being prevented. Therefore, a careful and precise metering of the amount of liquid to be added to the compressed air is no longer necessary, in that even an excess of liquid cannot cause any noxious effects, nor can it cause troubles and damages to the mechanical members of the device, or elsewhere.

Figure 2:
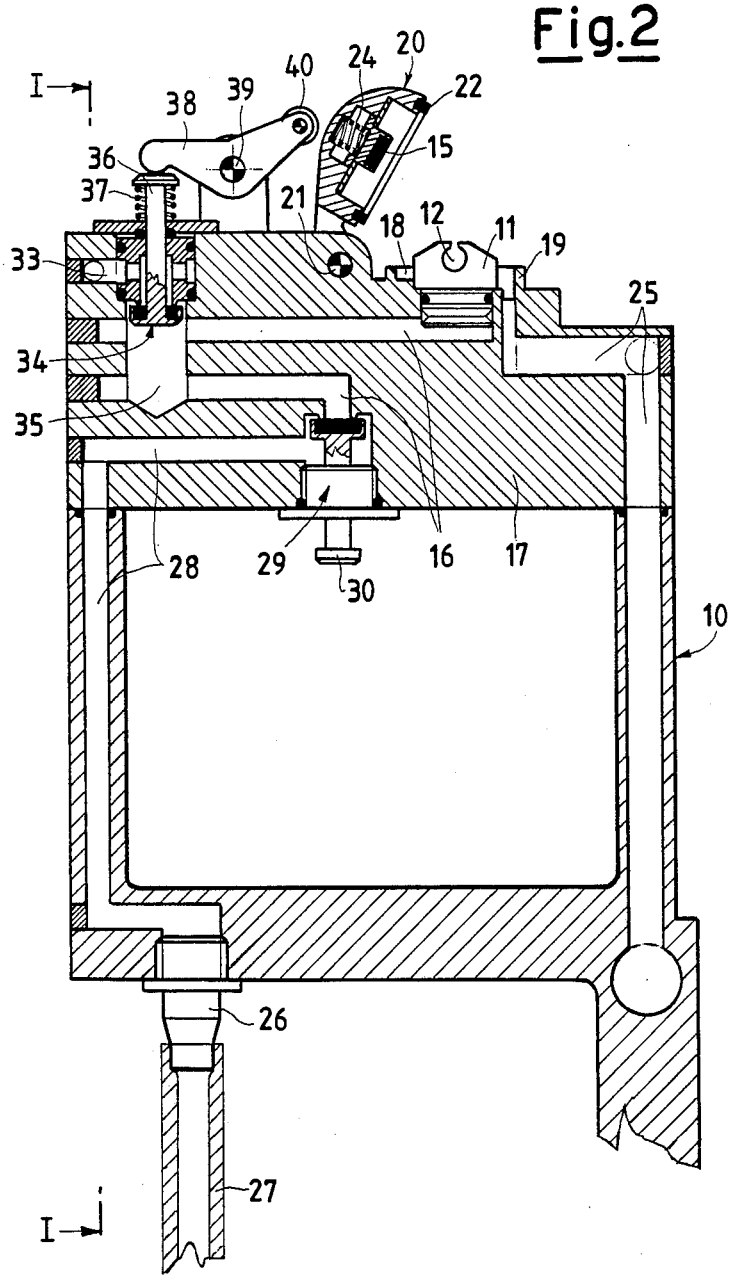
Figure 3:
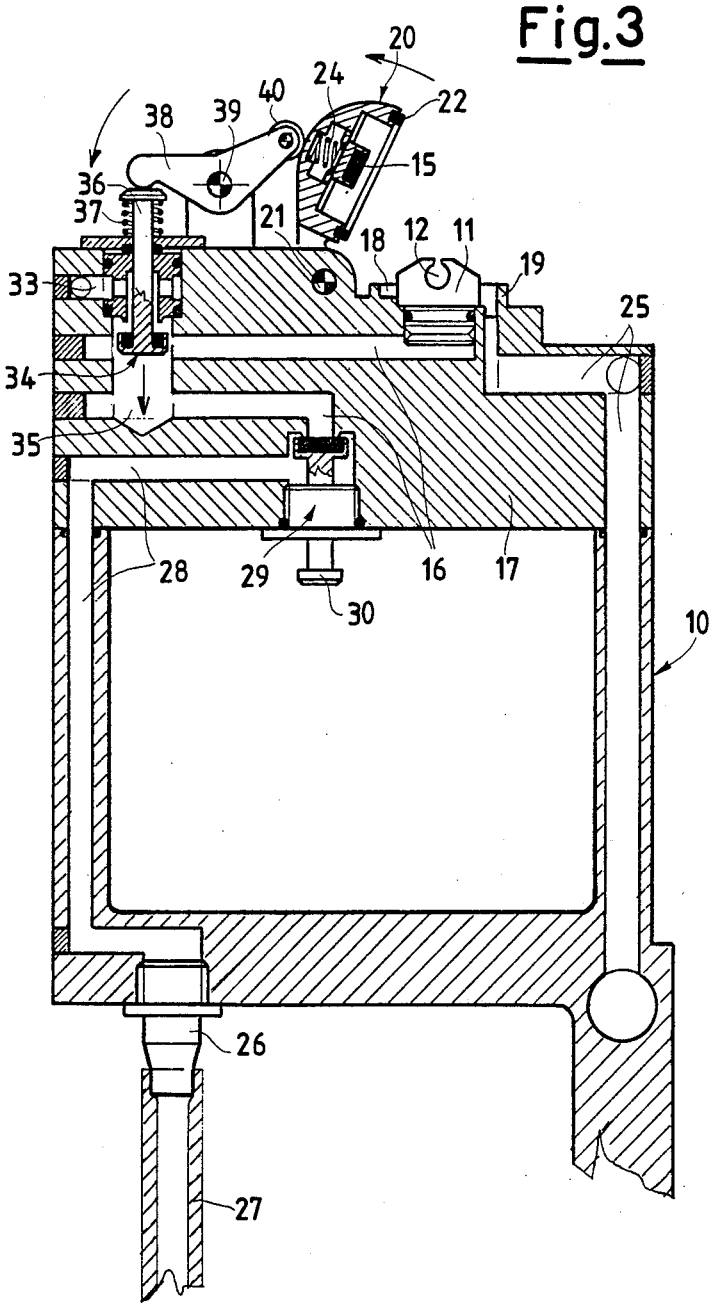
Figure 4:
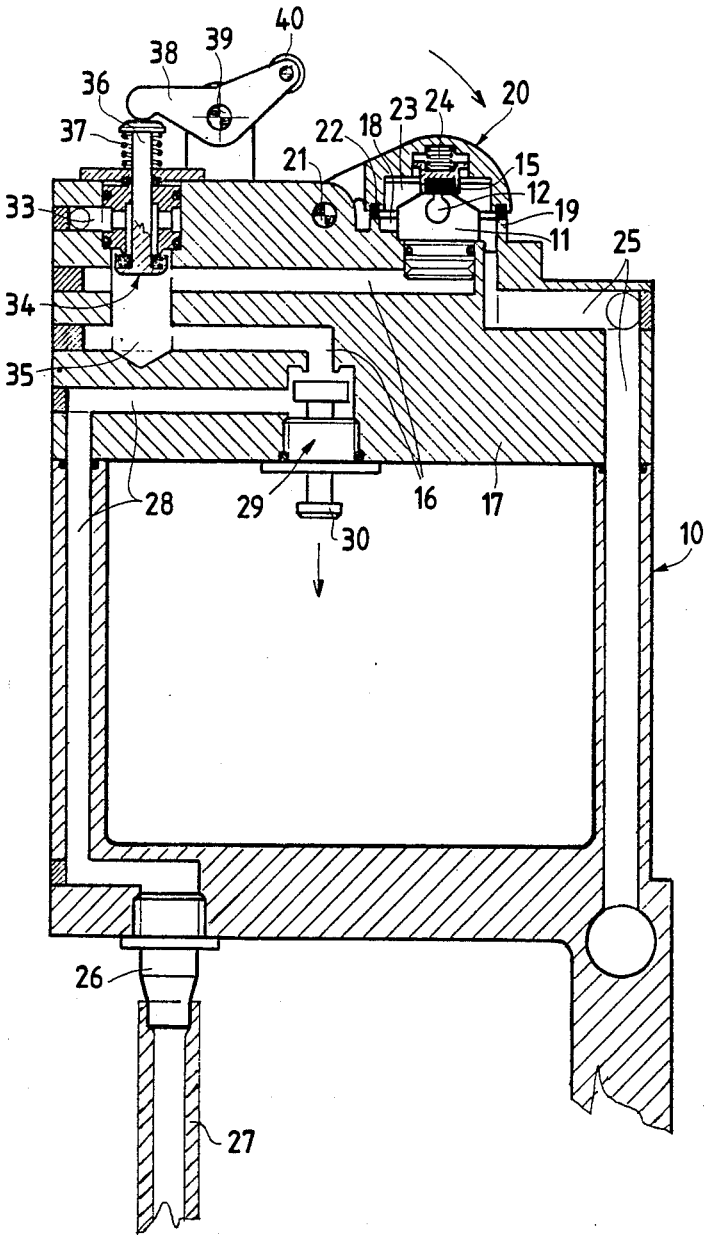
Figure 5:
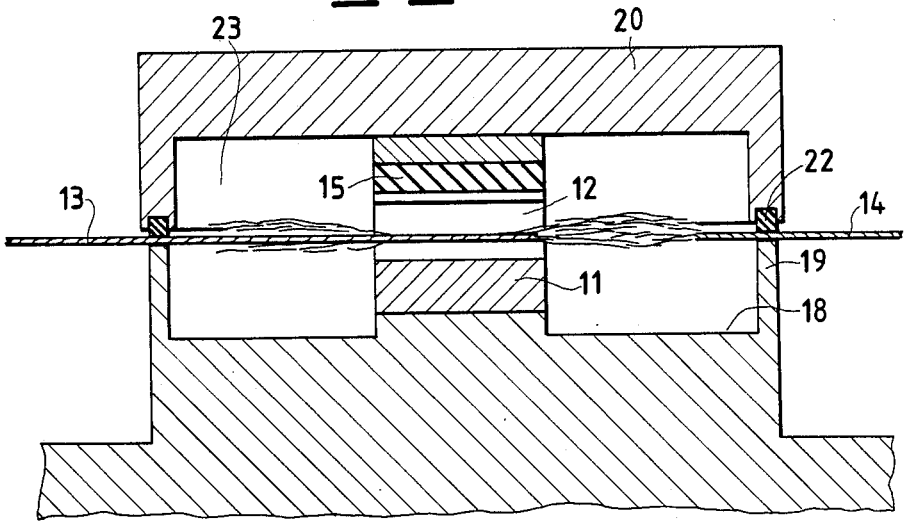
Figure 6:
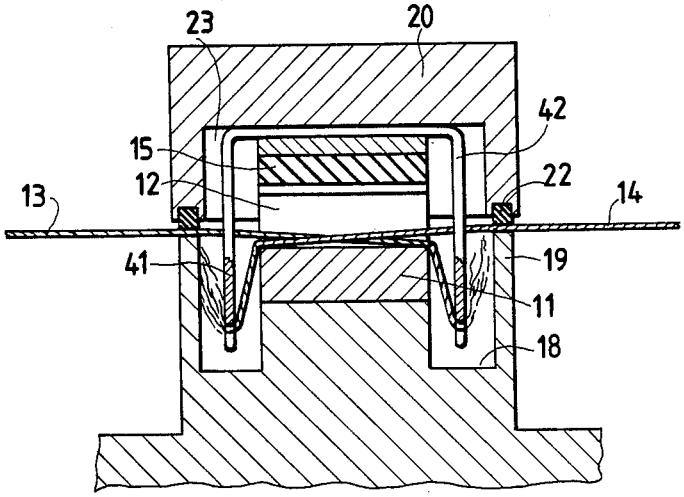

The characteristics of the invention and the advantages which derive from it will result in greater detail from the following disclosure of an exemplifying form of practical embodiment of the splicing device, made by referring to the hereto attached drawings, wherein:

FIG. 1 shows a sectional front view of the device along path I—I of FIG. 2;

FIGS. 2, 3, and 4 show respective sectional views of the device, made along the path II—II of FIG. 1, in different operating steps;

FIG. 5 shows a longitudinal sectional schematic view of the tank with the mixing chamber during the splicing operations; and FIG. 6 shows a different form of practical embodiment according to the same schematic view as of FIG. 5.

The splicing device according to the invention is of a well-known type, e.g., from U.S. Pat. No. 4,437,298 or from U.S. Pat. No. 4,574,573, so in the drawing and in the following disclosure exclusively only those parts of the device are respectively illustrated and discussed, which are essential for a complete understanding of the invention.

It is understood that all the other parts of the device, in particular all the mechanical members and their function can be accomplished according to the prior art, in particular in accordance with what emerges from the above mentioned U.S. patents.

The device, generally indicated by the reference numeral 10, comprises a body 17 on which a splicing head 11 is mounted, in the interior of which a mixing chamber 12 is provided, inside which the pneumatic joining or splicing of two threads or yarns 13 and 14—previously introduced into the same chamber—is carried out (see FIGS. 5 and 6). Advantageously, the splicing operation takes place after a suitable pre-treatment of the free ends of both threads or yarns 13, 14 (as disclosed, e.g., in U.S. Pat. No. 4,574,573), the purpose of which is of opening the fibres in correspondence of said free ends, and arranging them in a mutual parallel position.

In the herein illustrated case, the mixing chamber 12 can be closed atop by means of a cover 15 during the splicing operation, with both its longitudinal ends remaining open.

Into the chamber 12 at least one channel (not visible) leads, which runs through the head 11, and is in communication with a supply duct 16 provided inside the body 17 of the device 10.

The splicing head 11 is positioned inside the interior of a tank 18 provided in the upper part of the body 17 and bounded by a protruding perimetrical wall 19 which surrounds along its four sides, at a certain distance, the whole head 11. This tank 18 can be tightly sealed, on command, by means of a top sealing member 20 mounted rotatable around an axis 21 on the body 17 of the device, and bearing, in correspondence of its lower edge, a perimetrical gasket 22 destined to come into contact with the upper edge of the perimetrical protruding wall 19 which surrounds the tank 18, when the sealing member 20 is brought from a lifted position (FIGS. 2, 3) to a lowered position (FIGS. 4, 5, 6). In this latter position, the tank 18, together with the sealing member 20, enclose a chamber 23, only containing the splicing head 11, but otherways completely isolated from the remaining parts and the mechanical members of the device.

The drive means, for controlling the movement of the sealing member 20 from its open position to its closed position, and vice-versa, are not shown, and can be derived easily, and in an way obvious for those skilled in the art, from the motor means for the device, of course under the desired synchronism with the movements of the other movable parts of the same device.

In case a cover 15 is provided in order to close the mixing chamber 12 at its upper side, such a cover 15 can be mounted inside the interior of the sealing member 20, advantageously with the interposition of elastic means 24, so that at the time of closing of said sealing member 20, the chamber 12 is closed first by the cover 15, and the chamber 23 is subsequently closed by the coming of the gasket 22 of the sealing member 20 to rest on the top edge of the protruding perimetrical wall 19.

From the floor of the tank 18 a duct 25 starts, which can be provided inside the body 17 of the device and which, possibly through further ducts or pipes (not depicted in the figures) leads to the outside, in order to discharge the mixture of compressed air and liquid delivered into the mixing chamber 12 during the splicing operation. This discharge takes hence place at a site far away from the splicing device.

For generating the mixture of compressed air and liquid, the following means can be provided.

The body 17 of the device 10 is provided, at its bottom, with a connection piece 26 to which a pipe 27 is connected, which at its other end is connected to a source of compressed air (not shown). Ducts 28 provided inside the interior of the body 17 start from the connection piece 26 and lead to the usual valve 29 in order to feed compressed air, through the compressed air delivery duct 16, to the mixing chamber 12. The valve 29 can be controlled, in a known way, through a pushbutton 30, by the mechanical members of the device. By lowering said pushbutton 30 (see FIG. 4), against the action of elastic means, not shown in the figures, compressed air can flow from the ducts 28 into the duct 16, whilst, when the pushbutton 30 is lifted (FIGS. 2, 3), said passage is interrupted.

The body 17 of the device is provided with a second connection piece 31 which, through a pipe 32, is connected to a liquid reservoir (not shown), positioned at a higher level than of the device 10, so that the liquid can simply reach the device 10 by gravity. Ducts 33 provided inside the body 17 of the device connect the connection piece 31 to a liquid delivery-controlling valve 34. The outlet of this valve 34 is in communication with a liquid-collecting well 35 provided inside the body 17, and interposed along the duct 16 through which compressed air is fed to the mixing chamber 12. In other words, from the well 35 one branch of the duct 16 runs towards the outlet of the compressed air-delivery valve 29, and the other branch of same duct 16 leads to the splicing head 11, and through the channel provided inside it, reaches the mixing chamber 12.

The stem 36 of the valve 34 is submitted to the action of a spring 37, which keeps closed the same valve, whilst, by applying a pressure to the free end of said stem 36, the valve is opened. In order to drive the opening of the valve 34, a double-arm lever 38 is provided, which is mounted rotatable around a pivot 39 on the body 17 of the device; an end of said double-arm lever can act on the free end of the stem 36 of the valve 34, and on the other end of said double-arm lever, bearing a roller 40, the curved back of the sealing member 20 can act (see FIG. 3), in order to cause the valve 34 to open.

The device operates as follows.

After the introduction, from atop, of the threads or yarns 13 and 14 to be spliced inside the chamber 12, with the sealing member 20 being lifted and the valves 29 and 34 being closed, and after the possible preliminary preparation of the free ends of the threads or yarns (condition as per FIGS. 2 and 5), the sealing member 20 is made slightly rotate in the direction which brings it farther away from the splicing head 11 (see FIG. 3), so that its curved back drives the valve 34 to open, in order to cause a determined amount of liquid to come from the ducts 33 into the well 35, wherein the liquid is temporarily collected. By suitably adjusting the opening time of the valve 34, this amount of liquid can be varied.

Then, by means of the rotation in the reverse direction of the sealing member 20, the valve 34 is closed again, and the sealing member 20 approaches the splicing head 11. During this approaching movement, the cover 15, borne by the sealing member 20, closes first the upper longitudinal slot of the mixing chamber 12, and then the gasket 22 comes into contact with the upper edge of the protruding perimetrical wall 19. Under this condition, while the cover 15 is urged by the spring 24 against the top plane of the head 11, closing the mixing chamber 12, the chamber 23—bounded by the tank 18, the perimetrical wall 19 and the sealing member 20—results to be tightly closed by the gasket 22, and isolated towards all parts and mechanical members of the device 10 (see FIG. 4), and inside this chamber 23 only the splicing head 11 is contained.

Now, the mechanical members of the device open the compressed air-delivery valve 29, by pushing down the pushbutton 30, so that compressed air enters the first branch of the duct 16 and from there flows through the well 35, wherein the previously introduced amount of liquid is contained, which amount of liquid is atomized by the compressed air and is entrained by this latter, in a finely and uniformly subdivided form, into the second branch of the duct 16, in order to enter the mixing chamber 12, wherein said compressed air carries out, in a known way, the splicing of the free ends of the two yarns or threads 13, 14. The time period during which compressed air is delivered through the valve 29 can be adjusted in a known way, in order to obtain the desired splice, and the valve 29 is finally closed again.

The compressed air, admixed with the liquid, which enters the mixing chamber 12, leaves it at its longitudinal ends, and enters then the tightly sealed chamber 23, from which it can flow outwards only through the duct 25. This duct conveys the air-liquid mixture towards the external environment, without that it may come into contact with parts and members of the device, which are hence protected from the noxious effects which such a mixture could cause to them.

It is thus evident that by means of the device according to the present invention, the amount of liquid to be added to the splicing air is not at all critical, and that even an amount can be delivered, which is in excess relatively to the amount which is strictly necessary in order to obtain the desired advantages on the splice formed betweeen the two threads or yarns. In fact, inasmuch as any contacts between the liquid entrained by the compressed air and the mechanical members of the device are prevented, no possibilities exist that those noxious effects, such as corrosion risks, may occur, which, according to the prior art, obliged the operators to carry out a very precise and careful metering of the liquid, by limiting the amount of this latter to the strictly essential amount in order to achieve a good splice.

As the liquid to be added to the compressed air used for the splicing, water, at room temperature, or even heated, preferably distilled water, is advantageously used. However, also other liquids can be used as well.

It should observed that with the closure of the sealing member 20 on the upper edge of the perimetrical wall 19 of the tank 18, both threads or yarns 13, 14, positioned inside the mixing chamber 12 in order to be spliced, get locked by the gasket 22. However, this locking should not concern also the free ends of said threads or yarns, which should remain free, in order that the splice may be formed.

Inasmuch as before the splicing these free ends protrude laterally from the chamber 12 (see FIG. 5), the perimetrical wall 19 of the tank 18 should be sufficiently spaced apart from the sides of the splicing head 11 in order to prevent the gasket 22 of the sealing member 20 from locking also said free ends of the threads or yarns 13, 14, when it is into contact with the upper edge of said perimetrical wall 19.

If, owing to reasons of overall dimensions, one wishes to decrease said distance of the perimetrical wall 19 from the sides of the head 11, with no danger that the free ends of the threads or yarns may get locked by the gasket 22 against the upper edge of said wall, it is possible to increase the depth of the tank 18 (see FIG. 6), and provide, inside the sealing member 20, introducing elements 41, 42 which, in the lowered, closed position of the sealing member 20, keep the free ends of the threads or yarns depressed, as it can be clearly seen from FIG. 6.

The present invention has been disclosed in an exemplifying form of practical embodiment thereof, but is is susceptible of many variations and changes. So, e.g., the water valve opening drive could be modified, and said valve could be driven by means of distinct drive means, instead of using the sealing member, of course always in synchronism with the other members of the splicing device. Also the generation of the compressed air-liquid mixture can take place differently from as hereinabove disclosed, keeping in mind that, thanks to the present invention, the metering of the amount of liquid to be added to compressed air is not at all critical.

What is claimed is:

1. Splicing device for splicing threads or textile yarns with the aid of a gas or compressed air to which a liquid is added, comprising a body on which a splicing head containing the mixing chamber is mounted, at least a feed duct, by means of which the liquid-admixed compressed air is fed, leading to said chamber, a controllable valve for the delivery of compressed air, and means for adding the liquid to compressed air before said compressed air is delivered into said chamber, characterized in that the splicing head with its mixing chamber are positioned inside an isolated tank, that controllable closure means are provided for tightly sealing said tank immediately before and during the splicing operation, and that from said tank a discharge duct starts, through which the liquid-admixed compressed air charged to said chamber during the splicing operation is discharged to the outside.

2. Device according to claim 1, characterized in that the tank is surrounded by a perimetrical wall, and that the closure means comprise a perimetrical gasket suitable for coming into contact with the edge of said perimetrical wall for the tight sealing.

3. Device according to claim 2, characterized in that the tank is provided inside the body on which the splicing head is mounted.

4. Device according to claim 2, characterized in that the sealing means are constituted by a sealing member mounted on the body of the device rotatable on command from a resting position spaced apart from said perimetrical wall of the tank, to a position in which said gasket comes into contact against said perimetrical wall.

5. Device according to claim 4, characterized in that inside the sealing member introduction elements are provided, which, in the position of closure of said sealing member, come to stand at both sides of the splicing head, introducing the free ends of the threads or yarns to be spliced into the tank.

6. Device according to claim 4, characterized in that the mixing chamber can be closed by means of a cover during the splicing operation, characterized in that said cover is mounted inside the sealing member and that elastic means are provided, which act between the sealing member and the cover, in order to keep this latter pressed against the splicing head when the sealing member is in its sealing position.

7. Device according to claim 1, characterized in that a liquid-delivery controllable inlet valve is provided, which leads to a well provided inside the body of the device interposed along the duct leading from the compressed air delivery valve to the interior of the mixing chamber.

8. Device according to claim 7, characterized in that the liquid inlet valve can be driven by the sealing member when said sealing member is in a position which is farther away from the perimetrical wall of the tank than its resting position.

* * * * *